US007794846B2

(12) United States Patent
Itou et al.

(10) Patent No.: US 7,794,846 B2
(45) **Date of Patent: *Sep. 14, 2010**

(54) TITANIUM PART FOR INTERNAL COMBUSTION ENGINE

(75) Inventors: Toshihiro Itou, Shizuoka (JP); Naohisa Takahashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 946 days.

This patent is subject to a terminal disclaimer.

(21) Appl. No.: 11/425,903

(22) Filed: Jun. 22, 2006

(65) Prior Publication Data

US 2006/0292386 A1 Dec. 28, 2006

(30) Foreign Application Priority Data

Jun. 22, 2005 (JP) ..... 2005-181877

(51) Int. Cl.
*B32B 9/00* (2006.01)

(52) U.S. Cl. ..... 428/469; 428/472; 428/701; 428/702

(58) Field of Classification Search ..... None
See application file for complete search history.

(56) References Cited

U.S. PATENT DOCUMENTS

| | | | |
|---|---|---|---|
| 5,249,554 | A | 10/1993 | Tamor et al. |
| 2003/0180571 | A1 | 9/2003 | Singh |
| 2006/0010862 | A1 | 1/2006 | Takahashi |

FOREIGN PATENT DOCUMENTS

| | | | |
|---|---|---|---|
| EP | 1 353 045 | A2 | 10/2003 |
| JP | 59-63317 | A | 4/1984 |
| JP | 02-13700 | U | 4/1990 |
| JP | 03-249313 | A | 11/1991 |
| JP | 04-041660 | A | 2/1992 |
| JP | 06-228733 | A | 8/1994 |
| JP | 07-102967 | A | 4/1995 |
| JP | 10-238320 | A | 9/1998 |
| JP | 2823169 | B | 9/1998 |
| JP | 2000-303833 | A | 10/2000 |
| JP | 2000-337126 | A | 12/2000 |
| JP | 3151713 | B | 1/2001 |
| JP | 2001-106155 | A | 4/2001 |
| JP | 2001-329376 | A | 11/2001 |
| JP | 3088978 | U | 7/2002 |
| JP | 2002-276359 | A | 9/2002 |
| JP | 2002-332838 | A | 11/2002 |
| JP | 2004-115907 | A | 4/2004 |

OTHER PUBLICATIONS

Takahashi, "Exhaust Pipe for Internal Combustion Engine," U.S. Appl. No. 11/177,088, filed Jul. 8, 2005.

(Continued)

*Primary Examiner*—Timothy M Speer
(74) *Attorney, Agent, or Firm*—Keating & Bennett, LLP

(57) ABSTRACT

A titanium part for use in an internal combustion engine includes a ceramic layer on its surface. The ceramic layer has a thickness that is greater than about 10 nm but equal to or less than about 750 nm and includes either silicon or aluminum.

23 Claims, 10 Drawing Sheets

OTHER PUBLICATIONS

Takahashi, "Exhaust Pipe for Internal Combustion Engine, and Internal Combustion Engine and Transportation Apparatus Incorporating the Same," U.S. Appl. No. 11/470,098, filed Sep. 5, 2006.

Official communication issued in a counterpart Chinese Application No. 2005100841582, mailed on Mar. 9, 2007.

Official Communication issued in corresponding European Patent Application No. 06012878.2, mailed on Sep. 1, 2009.

SiON

TiCN

TiAlN

SiON

TiCN

TiAlN

TITANIUM PART FOR INTERNAL COMBUSTION ENGINE

BACKGROUND OF THE INVENTION

1. Field of the Invention

The present invention relates to a titanium part made of either titanium or an alloy thereof, and more particularly, the present invention relates to a titanium part of an internal combustion engine that is exposed to the combustion gas of the internal combustion engine.

2. Description of the Related Art

Recently, titanium or an alloy thereof (which will be collectively referred to herein as a "titanium material") has been used more and more often as a material for an engine part in order to increase the output of an engine and decrease its weight.

Generally speaking, a titanium material is a lightweight material that has high mechanical strength but low abrasion resistance. That is why a titanium part that should have high abrasion resistance is sometimes subjected to an oxidation treatment. If a titanium part is processed by an oxidation treatment, a hard titanium oxide film is formed on the surface of the titanium part, thus increasing the abrasion resistance of the titanium part. However, since titanium oxide is brittle, the titanium part with the titanium oxide film has decreased fatigue strength and decreased impact strength. The fatigue strength and impact strength of a titanium part can be increased to a certain degree by thickening the part. In that case, however, the weight of the part increases, which makes the use of the titanium material less meaningful.

Also, a titanium part that does not have to have high abrasion resistance need not be subjected to an oxidation treatment. However, even such a titanium part will also be oxidized when used in a high temperature environment and will eventually have decreased fatigue strength or impact strength too.

In order to overcome those problems, Japanese Patent No. 3151713 discloses a method of attaching aluminum powder on the surface of a titanium valve or a titanium connecting rod by a baking process. Meanwhile, Japanese Patent Application Laid-Open Publication No. 2004-115907 discloses a method of nitrifying a titanium part in a nitrifying chamber. According to each of these methods, the aluminum film or the titanium nitride film that has been formed on the surface of the titanium part functions as an oxygen barrier layer that prevents oxygen from reaching the titanium material as the base material. As a result, the oxidation of the titanium material is minimized and the fatigue strength and impact strength thereof are increased. Also, if the overall titanium part is subjected to an oxidation treatment after such an oxygen barrier layer has been formed on a predetermined portion of the titanium part, then sufficiently high fatigue strength can be ensured where the oxygen barrier layer has been formed and the abrasion resistance can be increased in the other regions (i.e., where a titanium oxide is produced as a result of the oxidation treatment).

According to the methods disclosed in Japanese Patent No. 3151713 and Japanese Patent Application Laid-Open Publication No. 2004-115907, however, good antioxidation effects are not achieved for the following reasons.

Specifically, if the aluminum film is used as an oxygen barrier layer, then a brittle layer of an intermetallic compound (between aluminum and titanium) is formed between the aluminum film and the titanium material layer, which is located inside the aluminum film, during the oxidation treatment or when the titanium part is used in a high temperature environment. Thus, this intermetallic compound layer may have cracks within due to the stress caused by the running engine and the function of the aluminum film as an oxygen barrier layer may decrease as a result. Consequently, good antioxidation effects are not always achieved by such a method. What is worse, the film formed by baking the powder becomes a porous layer that cannot function as a gas barrier layer effectively.

On the other hand, a titanium nitride is so hard and brittle that a titanium nitride film may also have very small cracks due to stress. That is why even if a titanium nitride film is used as an oxygen barrier layer, good antioxidation effects are not always achieved.

Furthermore, the aluminum film and titanium nitride film that have been formed as described above are not dense enough to have high oxygen barrier properties in the first place. For that reason, when exposed to a highly oxidizing gas such as the combustion gas of an engine, the gas will likely pass any of these films to reach and oxidize the underlying titanium material. As a result, a titanium oxide layer will have more and more cracks as the part is used over time. In many cases, eventually the part itself will soon have cracks itself.

SUMMARY OF THE INVENTION

In order to overcome the problems described above, preferred embodiments of the present invention provide a titanium part that is exposed to the combustion gas of an internal combustion engine having greatly increased fatigue strength and impact strength.

A titanium part for use in an internal combustion engine according to a first preferred embodiment of the present invention is made of either titanium or an alloy thereof and exposed to a combustion gas in the internal combustion engine. The titanium part includes a ceramic layer on the surface thereof. The ceramic layer has a thickness that is greater than about 10 nm but equal to or less than about 750 nm and preferably includes either silicon or aluminum.

In one preferred embodiment of the present invention, the ceramic layer has a thickness of about 20 nm to about 500 nm.

In another preferred embodiment, the ceramic layer has a thickness of about 50 nm to about 250 nm.

In still another preferred embodiment, the ceramic layer includes no greater than about 0.5 wt % of titanium.

A titanium part for use in an internal combustion engine according to a second preferred embodiment of the present invention is made of either titanium or an alloy thereof and exposed to a combustion gas in the internal combustion engine. The titanium part includes a ceramic layer on the surface thereof. The ceramic layer preferably includes either silicon or aluminum and no greater than about 0.5 wt % of titanium.

In one preferred embodiment of the present invention, the number of particulate deposits having particle sizes of about 1 μm or more on the surface of the ceramic layer is at most about 80 per square millimeter.

In another preferred embodiment, the ceramic layer preferably includes a silicon oxide, a silicon nitride, or a silicon oxynitride.

In an alternative preferred embodiment, the ceramic layer preferably includes an aluminum oxide, an aluminum nitride, or an aluminum oxynitride.

In still another preferred embodiment, the titanium part further includes either a titanium layer or a titanium alloy layer inside of the ceramic layer, and a titanium oxide layer with a thickness of about 1 μm or less between the ceramic layer and the titanium or titanium alloy layer.

In yet another preferred embodiment, the ceramic layer is provided on a selected surface area of the titanium part.

In this particular preferred embodiment, the titanium part further includes a titanium oxide layer with a thickness of at least about 10 μm on another surface area thereof.

In a specific preferred embodiment, the titanium part is used as a valve to make a combustion chamber for the internal combustion engine.

In that case, the valve is preferably an exhaust valve that opens and closes an exhaust port.

Alternatively or additionally, the titanium part may be used as a valve, which includes a stem portion, a face portion, and a neck portion that connects the stem and face portions together. The ceramic layer may be provided on the surface of the neck portion.

In this particular preferred embodiment, the stem portion includes a cotter portion to engage with a valve cotter, and the ceramic layer also covers the surface of the cotter portion.

In still another preferred embodiment, the titanium part is used as a valve, which includes a stem portion with a cotter portion to engage with a valve cotter. The ceramic layer covers the surface of the cotter portion.

In yet another preferred embodiment, the ceramic layer is a vapor-deposited film formed by a vapor deposition process.

In this particular preferred embodiment, the ceramic layer is preferably a vapor-deposited film formed by a sputtering process.

A titanium part for use in an internal combustion engine according to a third preferred embodiment of the present invention is made of either titanium or an alloy thereof and exposed to a combustion gas in the internal combustion engine. The titanium part includes a ceramic layer on the surface thereof. The ceramic layer has a thickness that is greater than about 10 nm but equal to or less than about 750 nm and includes no greater than about 0.5 wt % of titanium.

A titanium part for use in an internal combustion engine according to a fourth preferred embodiment of the present invention is made of either titanium or an alloy thereof and exposed to a combustion gas in the internal combustion engine. The titanium part includes a ceramic layer on the surface thereof. The ceramic layer preferably includes either silicon or aluminum. And the number of particulate deposits having particle sizes of about 1 μm or more on the surface of the ceramic layer is at most about 80 per square millimeter.

An internal combustion engine according to a preferred embodiment of the present invention may include a titanium part according to any of the preferred embodiments of the present invention described above.

A transportation apparatus according to a preferred embodiment of the present invention may include the internal combustion engine of any of the preferred embodiments described above.

A titanium valve for use in an internal combustion engine according to a preferred embodiment of the present invention is made of either titanium or an alloy thereof. The titanium valve includes a ceramic layer on a selected surface area thereof. The ceramic layer has a thickness that is greater than about 10 nm but equal to or less than about 750 nm and preferably includes either silicon or aluminum.

In one preferred embodiment of the present invention, the valve includes a stem portion to slide inside a valve guide, a face portion that contacts with a valve seat, and a neck portion that connects the stem portion and the face portion together. The ceramic layer covers the surface of the neck portion.

In this particular preferred embodiment, the stem portion includes a cotter portion to engage with a valve cotter, and the ceramic layer also covers the surface of the cotter portion.

In still another preferred embodiment, the valve includes a stem portion to slide inside a valve guide. The stem portion includes a cotter portion to engage with a valve cotter, and the ceramic layer covers the surface of the cotter portion.

A method of making a titanium part for an internal combustion engine according to a preferred embodiment of the present invention is designed to make a titanium part to be exposed to a combustion gas in the internal combustion engine. The method includes the steps of providing a titanium part made of either titanium or an alloy thereof, and depositing a ceramic layer to a thickness of greater than about 10 nm but equal to or less than about 750 nm on the surface of the titanium part by a vapor deposition process.

In one preferred embodiment of the present invention, the step of depositing includes depositing a ceramic layer including either silicon or aluminum.

In another preferred embodiment, the step of depositing includes depositing a ceramic layer including no greater than about 0.5 wt % of titanium.

In still another preferred embodiment, the step of depositing includes depositing the ceramic layer by a sputtering process.

In yet another preferred embodiment, the step of depositing includes depositing the ceramic layer only on a selected surface area of the titanium part.

In yet another preferred embodiment, the method further includes the step of forming a titanium oxide layer with a thickness of at least about 10 μm on another surface area of the titanium part after the step of depositing has been performed.

A titanium part according to the first preferred embodiment of the present invention includes a ceramic layer on its surface. This ceramic layer preferably includes either silicon or aluminum, and therefore, can be dense enough to have high oxygen barrier properties. In addition, this ceramic layer has a thickness that is greater than about 10 nm but equal to or less than about 750 nm, and is not too thin to exhibit expected oxygen barrier properties or too thick to avoid cracking. That is why even if this titanium part is used at an elevated temperature for a long time, good antioxidation effects can still be achieved and high fatigue strength and high impact strength are realized too.

A titanium part according to the second preferred embodiment of the present invention also includes a ceramic layer on its surface. This ceramic layer preferably includes either silicon or aluminum, and therefore, can be dense enough to have high oxygen barrier properties. In addition, this ceramic layer includes only about 0.5 wt % or less of titanium, which is too small of an amount to make any difference. That is to say, this ceramic layer includes no titanium substantially. Thus, it is possible to prevent the base titanium material from being oxidized by way of the titanium included in the ceramic layer. That is why even if this titanium part is used at an elevated temperature for a long time, good antioxidation effects can still be achieved and high fatigue strength and high impact strength are realized too.

A titanium part according to the third preferred embodiment of the present invention also includes a ceramic layer on its surface. This ceramic layer has a thickness that is greater than about 10 nm but equal to or less than about 750 nm, and is not too thin to exhibit expected oxygen barrier properties or too thick to avoid cracking. In addition, this ceramic layer includes only about 0.5 wt % or less of titanium, which is too small of an amount to make any difference. That is to say, this ceramic layer includes almost no titanium. Thus, it is possible to prevent the base titanium material from being oxidized by way of the titanium included in the ceramic layer. That is why even if this titanium part is used at an elevated temperature for a long time, good antioxidation effects can still be achieved and high fatigue strength and high impact strength are realized too.

A titanium part according to the fourth preferred embodiment of the present invention also includes a ceramic layer on its surface. This ceramic layer preferably includes either silicon or aluminum, and therefore, can be dense enough to have high oxygen barrier properties. Also, the number of particulate deposits having particle sizes of about 1 μm or more on the surface of the ceramic layer is at most about 80 per square millimeter. That is to say, almost no coarse particles are deposited on the surface of the ceramic layer. Consequently, the ceramic layer is dense enough to achieve good antioxidation effects even though its thickness is in the range of several tens to several hundreds of nanometers.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIGS. 5A and 5B show a cross section of the valve as viewed on the plane V-V in FIG. 5C (i.e., a cross section including a ceramic layer).

FIGS. 6A and 6B show a cross section of the valve as viewed on the plane VI-VI in FIG. 6C (i.e., a cross section including no ceramic layer).

DETAILED DESCRIPTION OF PREFERRED EMBODIMENTS

Hereinafter, preferred embodiments of the present invention will be described with reference to the accompanying drawings. In the following description, parts made of titanium and parts made of titanium alloys will be collectively referred to herein as "titanium parts". A titanium part according to the preferred embodiments of the present invention has fatigue strength and impact strength that are high enough to use as a part for an internal combustion engine effectively although the part is exposed to a combustion gas. Hereinafter, preferred embodiments of the present invention will be described as being applied to a titanium valve as an exemplary titanium part.

Figure 1:
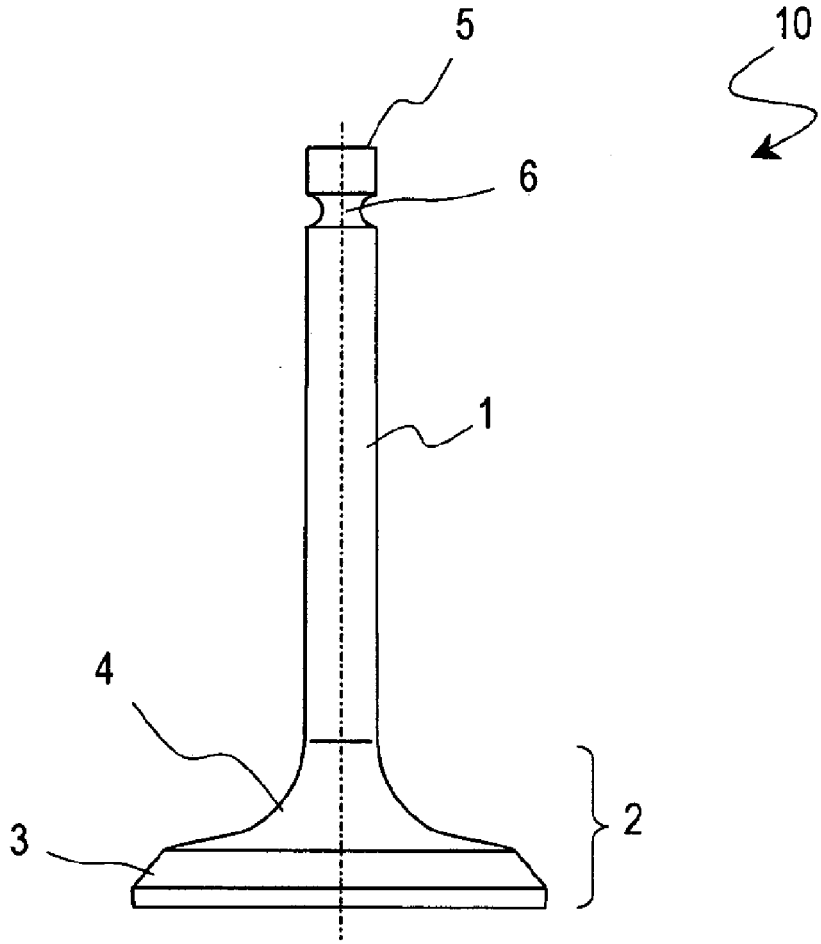
FIG. 1 is a front view schematically illustrating a titanium valve according to a preferred embodiment of the present invention.

FIG. 1 illustrates a titanium valve 10 according to a preferred embodiment of the present invention. The titanium valve 10 is made of a titanium material (i.e., either titanium or a titanium alloy). In the present specification, a "titanium alloy" is defined as an alloy which contains titanium as a main component and to which at least one of Al, V, Fe, Mo, Cr, Zr, Sn and C (preferably at least Al) is added in an amount of no less than 0.5 wt % and no more than 10.0 wt %.

The titanium valve 10 includes a rod-like stem portion 1 and an umbrella-like umbrella portion 2. The umbrella portion 2 includes a truncated conical face portion 3 to contact with a valve seat and a neck portion 4 that connects the stem portion 1 and the face portion 3 together.

The end 5 of the stem portion 1, opposite to the umbrella portion 2, will be referred to herein as a "stem end". In the vicinity of the stem end 5 of the stem portion 1, there is a recessed portion 6 to engage with a valve cotter (which will be referred to herein as a "cotter portion").

Figure 2:
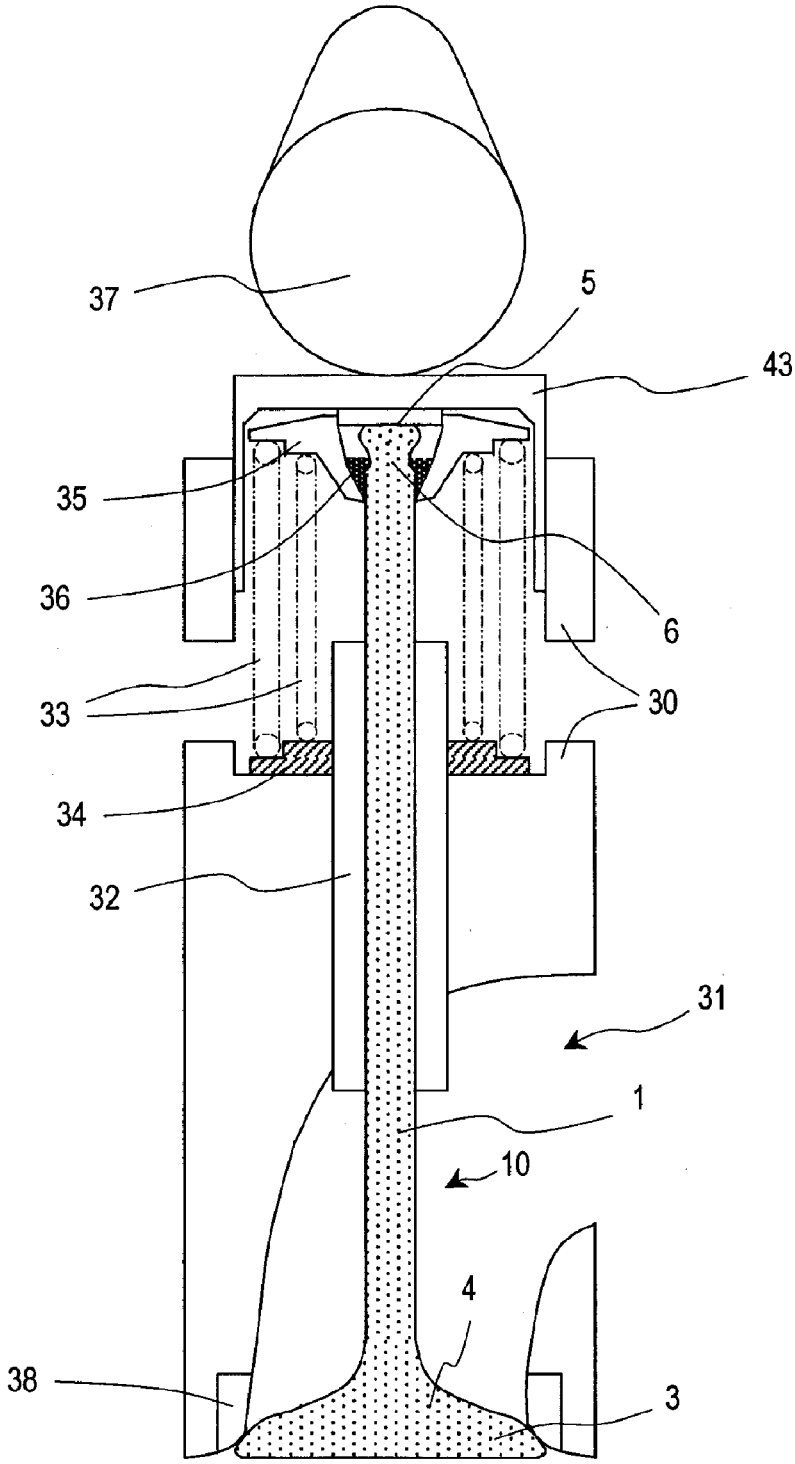
FIG. 2 shows a titanium valve according to a preferred embodiment of the present invention fitted into an exhaust port of an engine.

FIG. 2 shows the titanium valve 10 fitted into the exhaust port 31 of an engine. As shown in FIG. 2, the exhaust port 31 is designed so as to extend from the bottom of a cylinder head 30 toward a side surface thereof.

A hole cut through the cylinder head 30 has a valve guide 32, into which the stem portion 1 of the titanium valve 10 is inserted. A valve spring 33 applies elastic force to the titanium valve 10 so as to lift the titanium valve 10 upward.

The valve spring 33 is held by a spring seat 34 and a retainer 35. The retainer 35 is fixed on the stem portion 1 of the titanium valve 10 by way of a valve cotter 36 that engages with the cotter portion 6 of the titanium valve 10.

Above the titanium valve 10, there is a rotatable cam 37. By turning the cam 37, the raised portion (i.e., the portion with an increased size) of the cam pushes a valve lifter 43 down while the valve spring 33 pushes the titanium valve 10 up. In this manner, the titanium valve 10 moves up and down and the exhaust port 31 is opened and closed.

As the titanium valve 10 moves up or down, the stem portion 1 slides inside the valve guide 32. Also, when the titanium valve 10 returns to its uppermost position, the face portion 3 contacts with a valve seat 38, thereby closing the exhaust port 31. In this case, if the titanium valve 10 were subjected to an imbalanced impact, significant impact would be applied to the neck portion 4 and a bending stress would be caused too. If this phenomenon happened over and over again, then the valve 10 might eventually cause bending fatigue failure. Also, when the titanium valve 10 moves up or down, load will be placed on the stem end 5 that is located closer to the cam 37. The higher the revolution speed of the engine, the greater the force applied to the titanium valve 10.

Consequently, in a high revolution speed engine for use in a motorcycle, for example, much more significant impact is applied to the titanium valve 10.

As can be seen, every time the exhaust port 31 is opened or closed, the stem portion 1, face portion 3, and stem end 5 of the titanium valve 10 contact with other members. That is why these portions should have sufficiently high abrasion resistance. For that reason, a titanium oxide layer is preferably formed on the surface of these portions by subjecting them to an oxidation treatment. To achieve sufficiently high abrasion resistance, the titanium oxide layer preferably has a thickness of at least about 10 μm, for example.

On the other hand, the neck portion 4 and cotter portion 6 of the titanium valve 10 suffer stress when the titanium valve 10 is seated, and therefore, should have high fatigue strength and high impact strength. On the surface of the neck portion 4 and cotter portion 6 of the titanium valve 10 of this preferred embodiment, a ceramic layer to be described later is formed as an oxygen barrier layer, thus sufficiently increasing the fatigue strength and impact strength of these portions. Hereinafter, a ceramic layer according to this preferred embodiment will be described more specifically.

Figure 3:
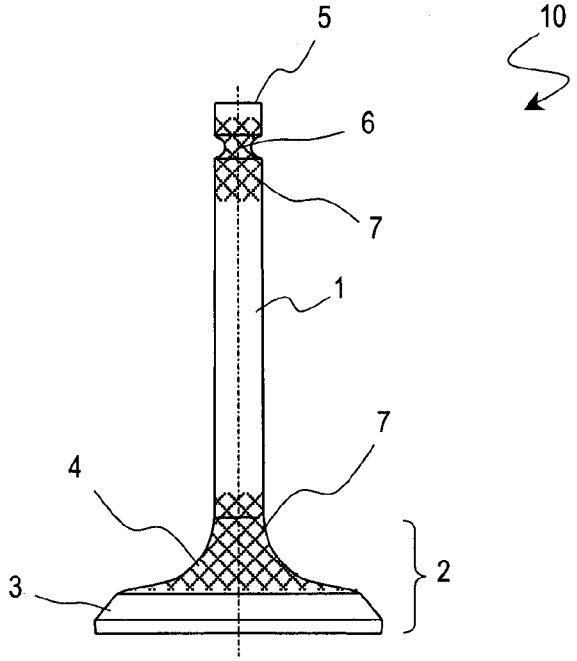
FIG. 3 is a front view schematically illustrating a titanium valve according to another preferred embodiment of the present invention.

In the titanium valve 10 of this preferred embodiment, the surface of the neck portion 4, cotter portion 6, and its surrounding area is coated with a ceramic layer 7 as indicated by the hatching in FIG. 3.

Specifically, the ceramic layer 7 is a ceramic film preferably including either silicon or aluminum. The ceramic layer 7 may be made of an oxide, a nitride, or an oxynitride of silicon or an oxide, a nitride, or an oxynitride of aluminum, for example.

A titanium-based ceramic film such as a titanium nitride film formed by the method disclosed in Japanese Patent Application Laid-Open Publication No. 2004-115907 is less likely to have a stoichiometric composition and has too low a density to have high oxygen barrier properties. In addition, since the composition of such a ceramic film is often non-stoichiometric, the ceramic film will have portions with a metallic bond. As a result, the film itself may be oxidized easily or may allow oxygen to pass inward.

In contrast, a silicon-based ceramic film includes a compound of a non-metallic element with a covalent bond, and therefore, may have a sufficiently high density. Also, aluminum is an element on the border between metallic elements and non-metallic elements. That is why an aluminum-based ceramic film can have as high a density as a silicon-based ceramic film. Consequently, the ceramic layer 7 of this preferred embodiment has high oxygen barrier properties. For that reason, even if the overall titanium valve 10 is subjected to an oxidation treatment to form a titanium oxide layer on the surface of the stem portion 1, face portion 3, and stem end 5, the oxidation can still be sufficiently reduced in the neck portion 4 and in the cotter portion 6. Furthermore, even when exposed to a combustion gas while the engine is running, the oxidation can also be reduced sufficiently in the neck portion 4 and in the cotter portion 6. Consequently, the titanium valve 10 of this preferred embodiment has high fatigue strength and high impact strength. What is more, there is no need to change the design of this part by increasing its thickness at the expense of its lightweight feature, since the part achieves sufficiently high fatigue strength and impact strength even without increasing its thickness.

Generally speaking, a nitride is usually denser and has higher gas barrier properties than an oxide. In view of this consideration, to achieve good antioxidation effects, the ceramic layer 7 is preferably not so much a silicon oxide film as a silicon oxynitride film, and more preferably a silicon nitride film. Likewise, the ceramic layer 7 should be an aluminum oxynitride film rather than an aluminum oxide film, and an aluminum nitride film is preferred to an aluminum oxynitride film.

From the standpoint of film density, a silicon-based ceramic film is preferred to an aluminum-based one. Meanwhile, considering that an inexpensive target is available, an aluminum-based ceramic film is preferred to a silicon-based one. Aluminum has such high electrical conductivity as to be used for sputtering more easily than silicon. Also, aluminum has such a low evaporation temperature as to be deposited by a vapor deposition process easily. Furthermore, an aluminum nitride has approximately 10 times as high thermal conductivity as an aluminum oxide and can resist thermal shock sufficiently. That is why an aluminum nitride film is preferably used for an engine to be driven under a heavy load.

If the ceramic layer 7 were too thin, then its gas barrier properties might be insufficient. However, if the ceramic layer 7 were too thick, the ceramic layer 7 might expand under an intense heat and possibly eventually crack. As will be described later, the present inventors discovered and confirmed via experiments that to avoid cracking with more certainty while maintaining reasonably high gas barrier properties, the ceramic layer 7 preferably has a thickness that is greater than about 10 nm but equal to or less than about 750 nm, more preferably about 20 nm to about 500 nm, and even more preferably about 50 nm to about 250 nm.

It should be noted that even where the surface is coated with the ceramic layer 7, the oxidation of titanium cannot be prevented completely. However, by providing the ceramic layer 7 as in this preferred embodiment, the thickness of the titanium oxide layer to be produced between the ceramic layer 7 and the titanium material layer (i.e., either a titanium layer or a titanium alloy layer) can be reduced to about 1 μm or less. As a result, the unwanted decrease in fatigue strength and impact strength that would be caused by a thick titanium oxide layer can be minimized.

Also, the ceramic layer 7 preferably includes almost no titanium. More specifically, the ceramic layer 7 preferably includes no greater than about 0.5 wt % of titanium. If substantial titanium were included in the ceramic layer 7, the titanium in the ceramic layer 7 might bond to oxygen (i.e., be oxidized) and might pass oxygen to the titanium in the base material that is made of the same element, and could eventually oxidize the base member. However, by setting the titanium content of the ceramic layer 7 to about 0.5 wt % or less (i.e., by substantially eliminating titanium from the ceramic layer 7), such oxidation can be sufficiently reduced. It should be noted that a titanium-based ceramic film is less likely to have a stoichiometric composition as described above, and therefore, includes a lot of unreacted titanium. That is why such a ceramic film would easily oxidize the base material.

Figure 4:
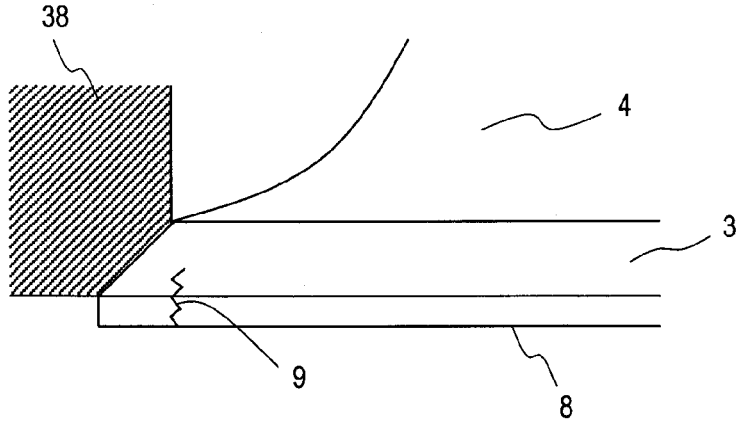
FIG. 4 schematically illustrates how a crack appears in the titanium valve when contacting with a valve seat.

In the preferred embodiment described above, the ceramic layer 7 covers both the neck portion 4 and the cotter portion 6. If necessary, however, the ceramic layer 7 may be formed only on the neck portion 4 or only on the cotter portion 6. Furthermore, the ceramic layer 7 is preferably formed on the surface of the umbrella portion 2 that will be opposed to the combustion chamber. As shown in FIG. 4, a crack 9 may appear on the surface 8 of the umbrella portion 2 that is opposed to the combustion chamber due to the impact caused when the titanium valve 10 contacts with the valve seat 38. Thus, by providing the ceramic layer 7 on the surface 8 opposed to the combustion chamber, the impact strength of the surface 8 can be increased and the likelihood of the crack 9 can be reduced significantly.

Hereinafter, a method of making the titanium valve 10 will be described.

First, a titanium valve 10 with no ceramic layer 7 is provided. The titanium valve 10 may be made of either pure titanium or any of various known titanium alloys. The titanium valve 10 with no ceramic layer 7 may be formed by any of various known methods.

Next, a ceramic layer 7 is deposited to a predetermined thickness on the surface of the titanium valve 10. In this process step, the ceramic layer 7 is deposited on selected surface areas of the titanium valve 10, more specifically, on the surface of the neck portion 4, on the surface of the cotter portion 6, and on the surface surrounding the cotter portion 6. As described above, to exhibit high gas barrier properties, the thickness of the ceramic layer 7 preferably exceeds about 10 nm, is more preferably equal to or greater than about 20 nm, and even more preferably equal to or greater than about 50 nm. On the other hand, to minimize cracking due to thermal expansion, the thickness of the ceramic layer 7 is preferably at most about 750 nm, more preferably about 500 nm or less, and even more preferably about 250 nm or less.

As also mentioned above, the ceramic layer 7 preferably includes virtually no titanium. That is why the ceramic layer 7 is preferably formed by such a method as to prevent titanium, included in the titanium valve 10 itself, from diffusing into, and staying in, the ceramic layer 7. More specifically, the ceramic layer 7 is preferably formed by a vapor deposition process. That is to say, the ceramic layer 7 is preferably a vapor-deposited film that has been formed by a vapor deposition process. As used herein, the "vapor deposition process" refers to a chemical vapor deposition (CVD) process and a physical vapor deposition (PVD) process in which the target substance is deposited in a gaseous state (preferably in a vacuum) . More particularly, the vapor deposition process should be a physical vapor deposition process such as a sputtering process or an ion plating process. Among other things, the ceramic layer 7 is most preferably formed by a sputtering process because a film deposited by a sputtering process has high density.

When a sputtering process is used, a DC sputterer, an RF sputterer, a magnetron sputterer, or an ion beam sputterer may be used. Also, if any of these methods is used, plasma particles may be made to collide against the surface of the titanium valve 10, on which the ceramic layer 7 is going to be deposited, such that the surface of the titanium valve 10 is etched (i.e., reverse-sputtered). In addition, by utilizing this phenomenon, a natural oxide film can be removed from the surface of the titanium valve 10 and the ceramic layer 7 can make closer contact with the titanium valve 10 itself as a result.

Even if the ceramic layer 7 is formed by a deposition process that uses no plasma, the natural oxide film on the surface of titanium valve 10 is preferably removed in advance by a physical or chemical technique before the ceramic layer 7 is deposited thereon.

Also, when a sputtering process is used, the ceramic layer 7 may be deposited only on selected surface areas of the titanium valve 10 by masking the other areas with a jig or shield, for example.

Thereafter, a titanium oxide layer is deposited to a predetermined thickness on the other surface areas of the titanium valve 10, i.e., on the stem portion 1, face portion 3, and stem end 5. To achieve sufficiently high abrasion resistance, the titanium oxide layer preferably has a thickness of at least about 10 μm. This oxidation treatment process is carried out by maintaining the titanium valve 10 at an ambient high temperature of about 650° C. to about 850° C. In this process step, in the surface areas coated with the ceramic layer 7, the ceramic layer 7 functions as an oxygen barrier layer thus minimizing the formation of the titanium oxide layer.

The present inventors made a sample of the titanium valve 10 of this preferred embodiment and performed various tests. The results are as follows.

First, a titanium valve 10 made of a titanium alloy with the composition Ti-6Al-4V was loaded into the chamber of a sputter vapor deposition apparatus which was then evacuated to a vacuum of approximately $3\times10^{-4}$ Pa.

Next, a reverse sputtering process was carried out for 1.5 minutes with argon introduced at a flow rate of 25 sccm into the chamber, with a maintained pressure of 0.4 Pa, and with a power of 500 V×4 A (=2.0 kW) applied thereto, thereby removing a natural oxide film from the surface of the titanium valve 10.

Subsequently, a sputtering process was performed for one minute using silicon as a target with the pressure maintained at 0.2 Pa within an argon and oxygen (or argon and nitride) atmosphere and with a power of 700 V×7 A (=4.9 kW) applied thereto, thereby depositing a silicon oxide film (or a silicon nitride film) to a thickness of 25 nm on the surface of the titanium valve 10. In this manner, a ceramic layer 7 was formed thereon.

The titanium valve 10 on which the ceramic layer 7 was deposited in this manner was kept heated at 700° C. for 24 hours in the air. As a result, the present inventors confirmed that the titanium oxide film existing between the titanium valve 10 itself (i.e., the layer of the titanium material) and the ceramic layer 7 had a thickness of 0.5 μm or less (which is virtually equal to zero). That is to say, it was confirmed that the formation of the titanium oxide film had been minimized.

Next, the present inventors made a number of different titanium valves with the thicknesses of their ceramic layers (e.g., silicon nitride films in this example) varied by changing the sputtering process time, and then evaluated their antioxidation effects. The results are shown in the following Table 1:

TABLE 1

| Thickness of ceramic layer | Antioxidation effect |
|---|---|
| 2 μm | X |
| 1 μm | X |
| 750 nm | Δ |
| 500 nm | ○ |
| 250 nm | ◎ |
| 50 nm | ◎ |
| 20 nm | ○ |
| 10 nm | X |

where ◎ indicates that the antioxidation effect was excellent, ○ indicates that the antioxidation effect was significant, Δ indicates that the antioxidation effect was good enough to actually use it, and × indicates that the antioxidation effect was insufficient.

As shown in Table 1, when the ceramic layer 7 had a thickness of 10 nm, the antioxidation effect was insufficient. This is because the film itself was too thin to have high gas barrier properties. That is to say, to exhibit good enough gas barrier properties, the thickness of the ceramic layer 7 is preferably greater than about 10 nm, more preferably equal to or greater than about 20 nm, and even more preferably equal to or greater than about 50 nm.

As also shown in Table 1, when the ceramic layer 7 had a thickness of 2 μm or 1 μm, the antioxidation effect was insufficient too. This is because the film cracked due to thermal expansion under an intense heat. But if the ceramic layer 7 had a thickness of less than 750 nm, no cracks appeared due to thermal stress and good antioxidation effects were achieved. However, when the ceramic layer 7 had a thickness of 750 nm, cracks sometimes appeared due to external stress or impact load according to the operating environment. The appearance of those cracks could be reduced when the ceramic layer 7 had a thickness of 500 nm or less and could be further reduced when the ceramic layer 7 had a thickness of 250 nm or less. Consequently, to avoid cracking due to thermal expansion, the thickness of the ceramic layer 7 is preferably about 750 nm or less, more preferably about 500 nm or less, and even more preferably about 250 nm or less.

Next, the present inventors subjected the titanium valve 10, which was coated with the ceramic layer 7 on those selected surface areas, to an oxidation treatment and observed their cross sections with an optical microscope and a scanning electron microscope for those areas with the ceramic layer 7 and the other areas with no ceramic layer 7.

Figure 5A:
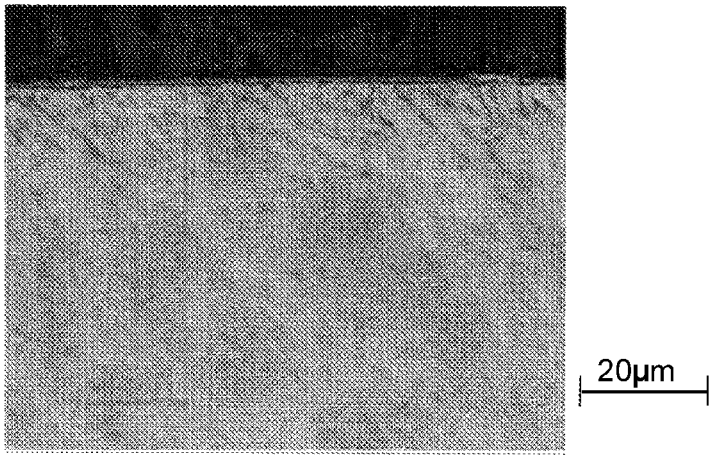
FIGS. 5A, 5B, and 5C are respectively an optical micrograph, a scanning electron micrograph, and a normal photo of a sample titanium valve, where
Figure 5B:
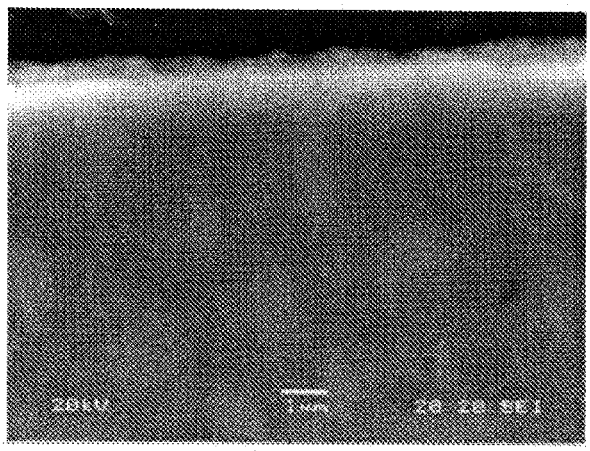
Figure 5C:
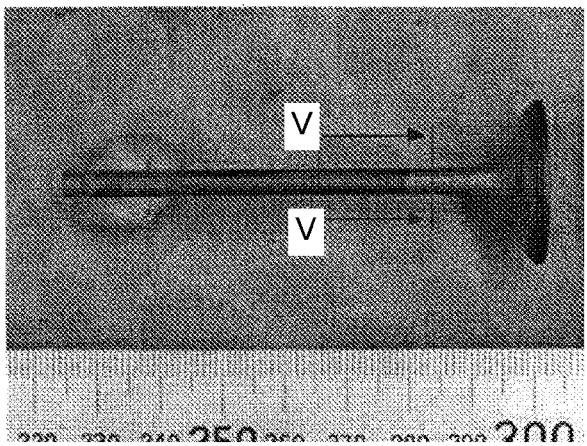

FIGS. 5A and 5B are, respectively, an optical micrograph and a scanning electron micrograph showing a cross section of an area with the ceramic layer 7 as viewed on the plane V-V in FIG. 5C.

As can be seen from FIG. 5A, an extremely thin titanium oxide layer with as small a thickness as 1 μm or less had been formed on the uppermost surface of the titanium valve 10. On the other hand, it can be seen from FIG. 5B that an extremely thin titanium oxide layer with as small a thickness as about 0.5 μm had been formed on the uppermost surface of the titanium valve 10.

Figure 6A:
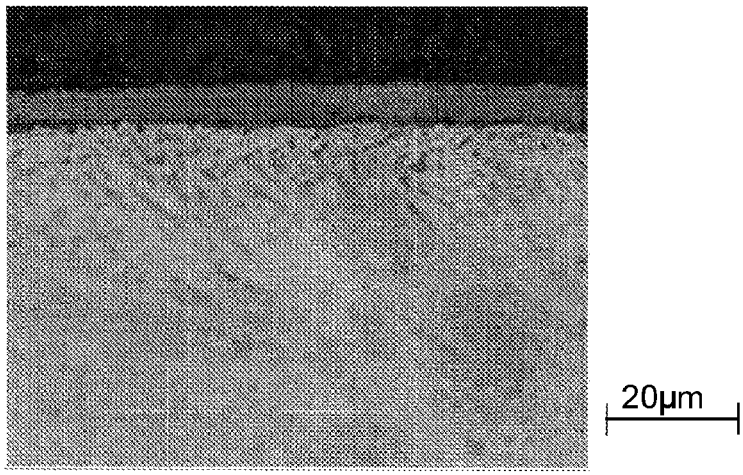
FIGS. 6A, 6B, and 6C are respectively an optical micrograph, a scanning electron micrograph, and a normal photo of a sample titanium valve, where
Figure 6B:
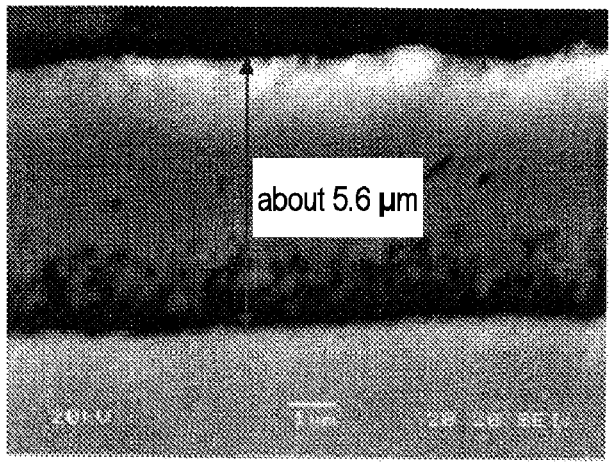
Figure 6C:
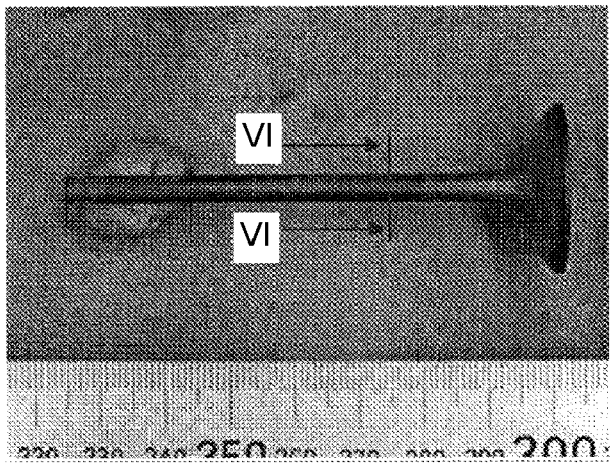

FIGS. 6A and 6B are, respectively, an optical micrograph and a scanning electron micrograph showing a cross section of an area with no ceramic layer 7 as viewed on the plane VI-VI in FIG. 6C.

As can be seen from FIG. 6A, a thick titanium oxide with a thickness of about 6 μm had been formed on the uppermost surface of the titanium valve 10. On the other hand, it can be seen from FIG. 6B that a thick titanium oxide with a thickness of about 5.6 μm had been formed on the uppermost surface of the titanium valve 10.

Thus, the thickness of the titanium oxide layer, formed by the oxidation treatment, was quite different between the surface area with the ceramic layer 7 and the surface area with no ceramic layer 7. As a result, the excellent antioxidation effects of the ceramic layer 7 of this preferred embodiment were confirmed.

Next, to estimate quantitatively the effects of the thickness of the titanium oxide layer on the fatigue strength, the present inventors carried out the following calculations.

The titanium oxide layer formed on the surface of a titanium part is so brittle as to be regarded as a sort of crack that has opened on the surface of the titanium part. Accordingly, by supposing the thickness of the titanium oxide layer to be the depth of the crack, a stress intensity factor Kl at the bottom of the crack may be regarded as one of the factors that determine the fatigue strength. The stress intensity factor Kl is a parameter representing the intensity of a stress field at the bottom of the crack and may be given by:

$$Kl=1.12\times\sigma\times\sqrt{(\pi\cdot a)}$$

where σ is the stress in action and a is the depth of the crack. As can be seen from this equation, the stress intensity factor Kl is proportional to the square root of the crack depth a. Thus it can be inferred that the stress intensity factor Kl is proportional to the square root of the thickness of the titanium oxide layer. With this inference in mind, by changing the oxidation treatment conditions, the present inventors changed the thicknesses of the titanium oxide layer and measured actual fatigue strengths. The following Table 2 shows how the fatigue strength changed with the thickness of the titanium oxide layer. Also, FIG. 7 is a graph showing how the fatigue strength changed with the square root of the thickness of the titanium oxide layer.

TABLE 2

| Oxidation treatment conditions | Thickness of titanium oxide layer (μm) | Square root of thickness of titanium oxide layer | Fatigue strength (MPa) |
|---|---|---|---|
| 820° C., 4 hrs | 40 | 6.32 | 230 |
| 820° C., 1 hr | 20 | 4.47 | 330 |
| 730° C., 8 hrs | 15 | 3.87 | 400 |
| 670° C., 16 hrs | 10 | 3.16 | 470 |

Figure 7:
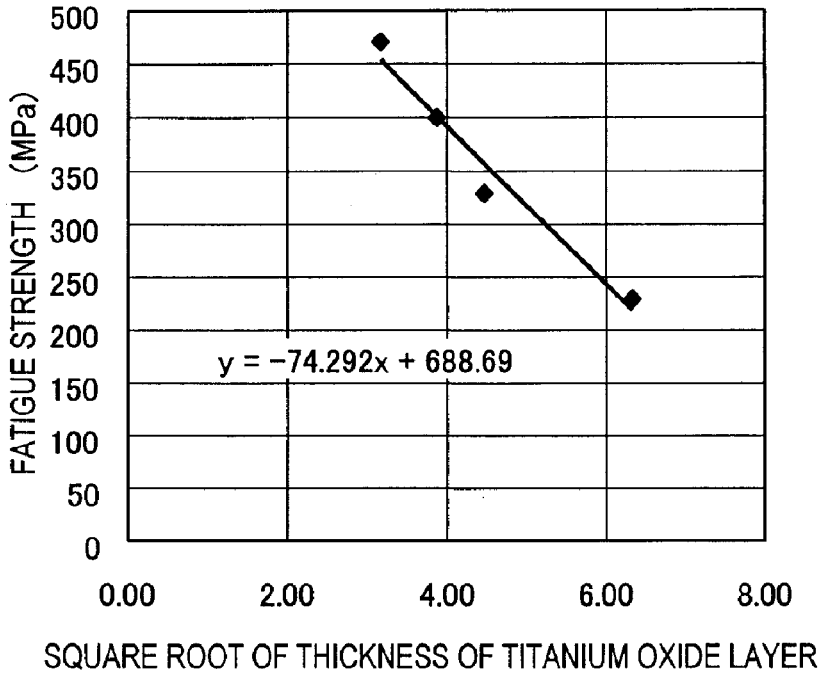
FIG. 7 is a graph showing how the fatigue strength (MPa) changes with the square root of the thickness (μm) of a titanium oxide layer.

As shown in Table 2 and FIG. 7, there is a good proportionality between the square root of the thickness of the titanium oxide layer and the fatigue strength. Thus, these results reveal that the thickness of the titanium oxide layer determines the fatigue strength of the titanium part.

According to the proportionality shown in FIG. 7, if a titanium oxide layer is formed to a thickness of about 10 μm or more to increase the abrasion resistance, the estimated fatigue strength would be about 470 MPa or less. On the other hand, if the thickness of the titanium oxide layer is reduced to about 1 μm or less by forming the ceramic layer 7, the estimated fatigue strength would be about 600 MPa or more. Consequently, it can be seen that the fatigue strength can be increased by approximately 22% or more by forming the ceramic layer 7.

For example, if the titanium oxide layer has a thickness of about 5.6 μm as shown in FIG. 6B, then the fatigue strength is about 518 MPa. On the other hand, if the titanium oxide layer has a thickness of about 0.5 μm as shown in FIG. 5B, then the fatigue strength is about 637 MPa, which is approximately 23% higher than the former strength.

The present inventors compared the antioxidation effect of a silicon oxynitride (SiON) film that had been formed by a sputtering process with that of a titanium carbide nitride (TiCN) film that had been formed by an ion plating process. The results will be described below. The following Table 3 shows whether or not cracks appeared on a titanium valve 10, including a silicon oxynitride film as the ceramic layer 7 on its surface, when subjected to a heating test at 700° C. for an hour and also shows how much the weight increased as a result of oxidation. The following Table 4 provides similar data about a titanium valve including a titanium carbide nitride film on its surface.

TABLE 3

| SiON film deposited by sputtering process | | | | | | | | | | |
|---|---|---|---|---|---|---|---|---|---|---|
| | Deposition process time (min) | | | | | | | | | |
| | 0.75 | 1.5 | 3.8 | 7.5 | 19.0 | 37.5 | 57 | 75 | 94 | 113 |
| Thickness | 10 nm | 20 nm | 50 nm | 100 nm | 250 nm | 500 nm | 750 nm | 1.00 μm | 1.25 μm | 1.50 μm |
| Cracks appeared after heated? | NO | NO | NO | NO | NO | NO | NO | YES, a little | YES | YES |
| Increase in weight (mg/cm$^2$) due to oxidation | 0.5 | 0.1 | >0.01 | >0.01 | >0.01 | >0.01 | >0.01 | >0.01 | >0.01 | >0.01 |

TABLE 4

| TiCN film deposited by ion plating process | | | | | | |
|---|---|---|---|---|---|---|
| | Deposition process time (min) | | | | | |
| | 3 | 7.5 | 15 | 30 | 45 | 60 |
| Thickness | 200 nm | 500 nm | 1.0 μm | 2.0 μm | 3.0 μm | 5.0 μm |
| Cracks appeared after heated? | NO | NO | YES | YES | YES | YES |
| Increase in weight ($mg/cm^2$) due to oxidation | 5.0 | 3.5 | 3.0 | 2.8 | 2.5 | 2.5 |

As can be seen by comparing the results shown in Tables 3 and 4 with each other, when the silicon oxynitride film was formed, the weight increased due to oxidation much less significantly than the situation where the titanium carbide nitride film was formed. That is to say, the silicon oxynitride film achieves much higher antioxidation effect than the titanium carbide nitride film does. It can also be seen from Table 3 that to minimize cracking, the thickness of the silicon oxynitride film is preferably about 750 nm or less, more preferably about 500 nm or less, and even more preferably about 250 nm or less, considering the amount of time it takes to deposit the film. Meanwhile, to have high oxygen barrier properties, the thickness of the silicon oxynitride film is preferably greater than about 10 nm, more preferably equal to or greater than about 20 nm, and even more preferably equal to or greater than about 50 nm.

As described above, the titanium carbide nitride film is not a silicon or aluminum based ceramic film and includes a substantial amount of titanium, thus achieving only low antioxidation effects. However, the difference between the results shown in Tables 3 and 4 also resulted from the difference in film deposition method. The present inventors carried out extensive research on the methods of forming a ceramic film. As a result, the present inventors discovered that a ceramic film with sufficiently high density could be formed more easily by a sputtering process than by an ion plating process.

Figure 8A:
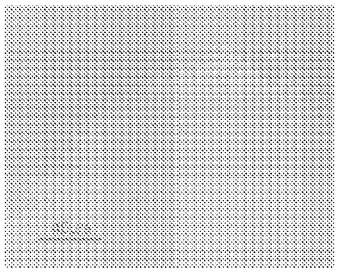
FIG. 8A is a micrograph showing the surface of a silicon oxynitride (SiON) film that was formed by a sputtering process.
Figure 8B:
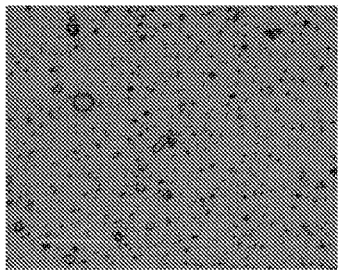
FIGS. 8B and 8C are micrographs showing the respective surfaces of a titanium carbide nitride (TiCN) film and a titanium aluminum nitride (TiAlN) that were formed by an ion plating process.
Figure 8C:
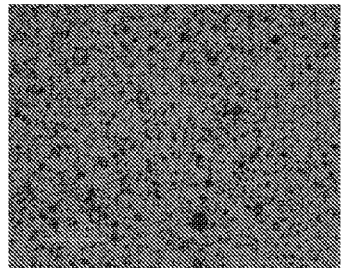

FIG. 8A is a micrograph showing the surface of a silicon oxynitride (SiON) film that was formed by a sputtering process, and FIGS. 8B and 8C are micrographs showing the respective surfaces of a titanium carbide nitride (TiCN) film and a titanium aluminum nitride (TiAlN) that were formed by an ion plating process.

As shown in FIGS. 8B and 8C, a lot of coarse particulate deposits were observed on the respective surfaces of the titanium carbide nitride film and the titanium aluminum nitride film that had been formed by the ion plating process. If such coarse particles are deposited, then the resultant film density will decrease. In that case, even if the thickness of the film is about 1 μm or more, there are still particulate deposits that are larger in size than the thickness of the film, thus easily making such a film porous. As a result, it is difficult to achieve high oxygen barrier properties.

On the other hand, on the surface of the silicon oxynitride film that had been formed by the sputtering process, no coarse particulate deposits were found as shown in FIG. 8A. Thus, the particles deposited are very fine (e.g., have particle sizes of less than about 1 nm), thus easily realizing high film density and high oxygen barrier properties. For that reason, even a silicon oxynitride film with a thickness of just several tens to several hundreds of nanometers achieves good antioxidation effects.

Figure 10A:
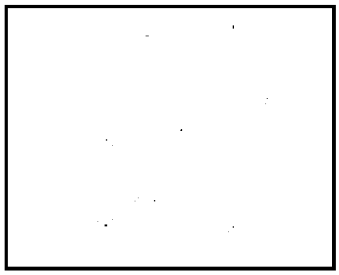
FIGS. 10A, 10B, and 10C are images obtained by processing the micrographs shown in FIGS. 8A, 8B, and 8C for an analysis purpose.
Figure 10B:
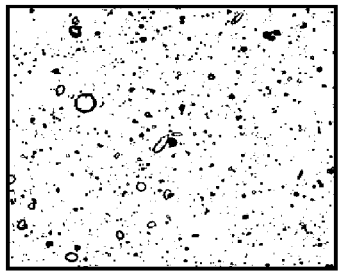
Figure 10C:
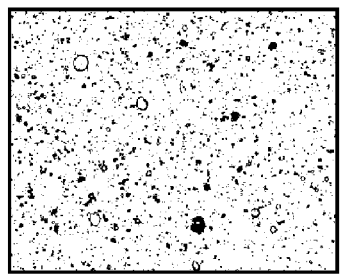
Figure 9:
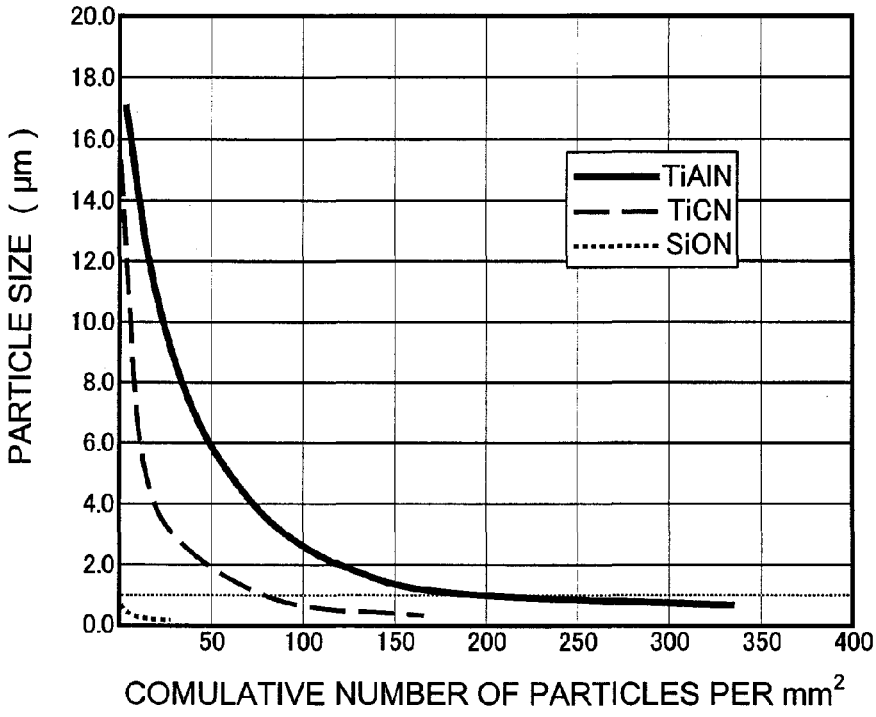
FIG. 9 is a graph showing the cumulative distribution of the particle sizes of particulate deposits on the surface of the silicon oxynitride film that was formed by a sputtering process, and on the surfaces of the titanium carbide nitride film and the titanium aluminum nitride film that were formed by an ion plating process.

Also, the number of coarse particulate deposits on the surface of the ceramic layer 7 may be used as a parameter for evaluating the density of a film. To achieve high oxygen barrier properties, the number of particulate deposits having particle sizes of about 1 μm or more on the surface of the ceramic layer 7 is preferably at most about 80 per square millimeter. FIG. 9 shows the cumulative distribution of the particle sizes of particulate deposits on the surface of the silicon oxynitride film that was formed by the sputtering process, and on the surfaces of the titanium carbide nitride film and the titanium aluminum nitride film that were formed by the ion plating process. The particle sizes and number of those particulate deposits can be obtained by subjecting the micrographs shown in FIGS. 8A, 8B, and 8C to image processing (typically, digitization) as shown in FIGS. 10A, 10B, and 10C and then analyzing them using a predetermined type of software (e.g., analySIS FIVE from Olympus Corporation).

As shown in FIG. 9, the number of particulate deposits having particle sizes of about 1 μm or more on the surface of the films formed by the ion plating process exceeded about 200 per square millimeter, whereas a much fewer number of particulate deposits with particle sizes of about 1 μm or more were present on the surface of the silicon oxynitride film that had been formed by the sputtering process. Specifically, only about 50 or fewer particulate deposited were found per square millimeter of the silicon oxynitride film. This is a result of using the silicon oxynitride film. However, a similar result was also obtained as for an aluminum oxynitride (AlON) film.

Figure 11:
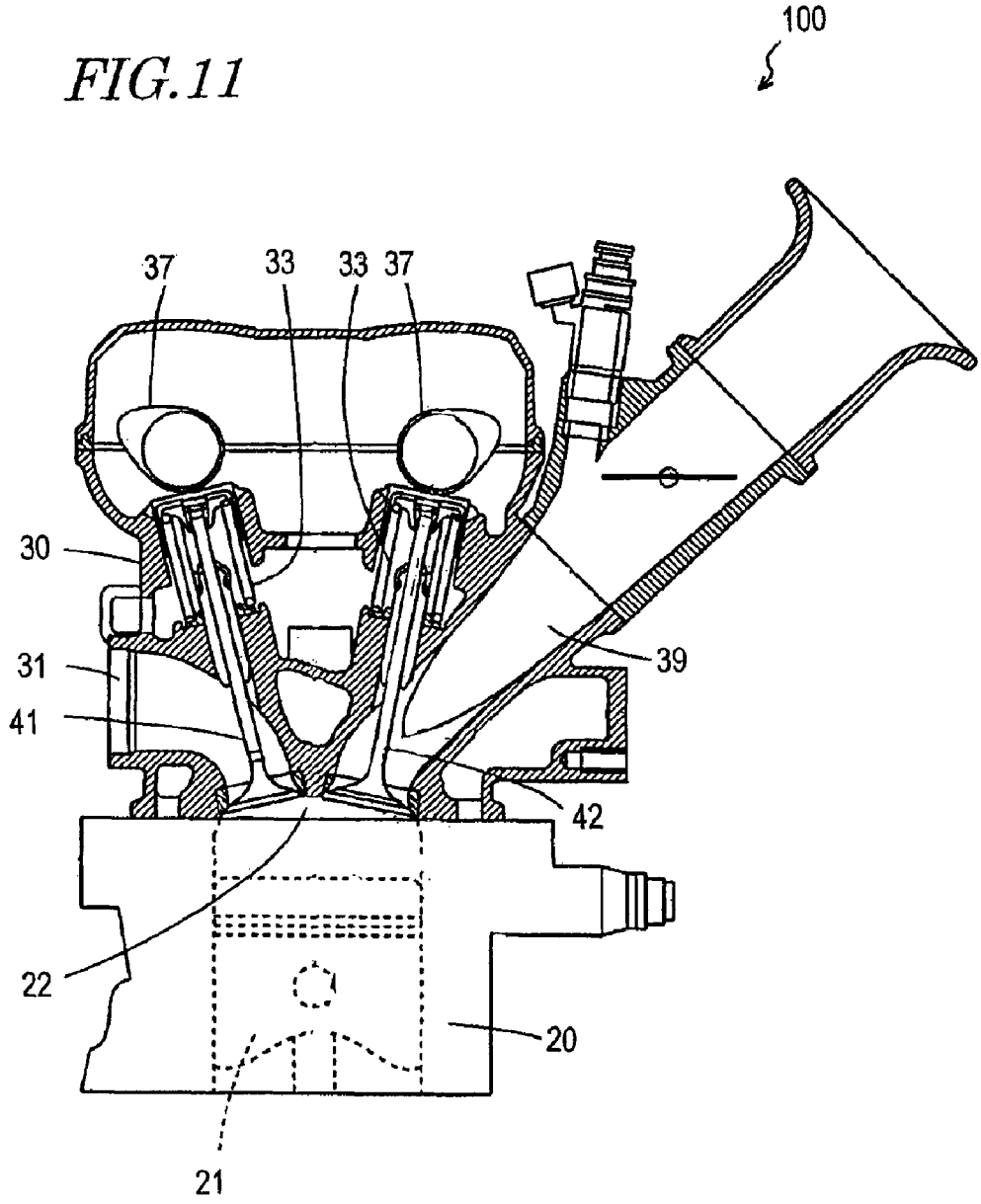
FIG. 11 is a cross-sectional view schematically illustrating an engine including a titanium valve according to a preferred embodiment of the present invention.

The titanium valve 10 of this preferred embodiment can be used extensively in any of various types of engines for motor vehicles and machines. The titanium valve 10 of this preferred embodiment has excellent fatigue strength and impact strength as described above, and therefore, can be used particularly effectively for an engine to be driven at a high revolution speed. FIG. 11 illustrates an exemplary engine 100 including the titanium valve 10.

As shown in FIG. 11, the engine 100 includes a cylinder 20, in which a piston 21 is arranged so as to reciprocate up and down. A cylinder head 30 is arranged over the cylinder 20.

An exhaust port 31 runs from one side of the cylinder head 30 toward the center of the bottom thereof. Also, an inlet port 39 runs from the other side of the cylinder head 30 toward the center of the bottom thereof.

An exhaust valve 41 and an inlet valve 42 are arranged at the respective bottom openings of the exhaust port 31 and the inlet port 39. The exhaust valve 41 and the inlet valve 42 receive elastic force from valve springs 33 so as to move obliquely upward. Rotatable cams 37 are arranged over both the exhaust valve 41 and inlet valve 42. When the cams 37 rotate, the exhaust valve 41 and inlet valve 42 move up and down, thereby opening and closing the exhaust port 31 and inlet port 39 at predetermined timings.

The exhaust valve 41, inlet valve 42, cylinder 20, and cylinder head 30 form a combustion chamber 22. The engine 100 includes the titanium valves 10 of this preferred embodiment as the exhaust valve 41 and the inlet valve 42, and therefore, has good durability. Both of the exhaust valve 41 and inlet valve 42 need not be the titanium valves 10 of this preferred embodiment. However, at least the exhaust valve 41 is preferably the titanium valve 10 of this preferred embodiment because the exhaust valve 41 for opening and closing the exhaust port 31 is always exposed to a high-temperature combustion gas.

Figure 12:
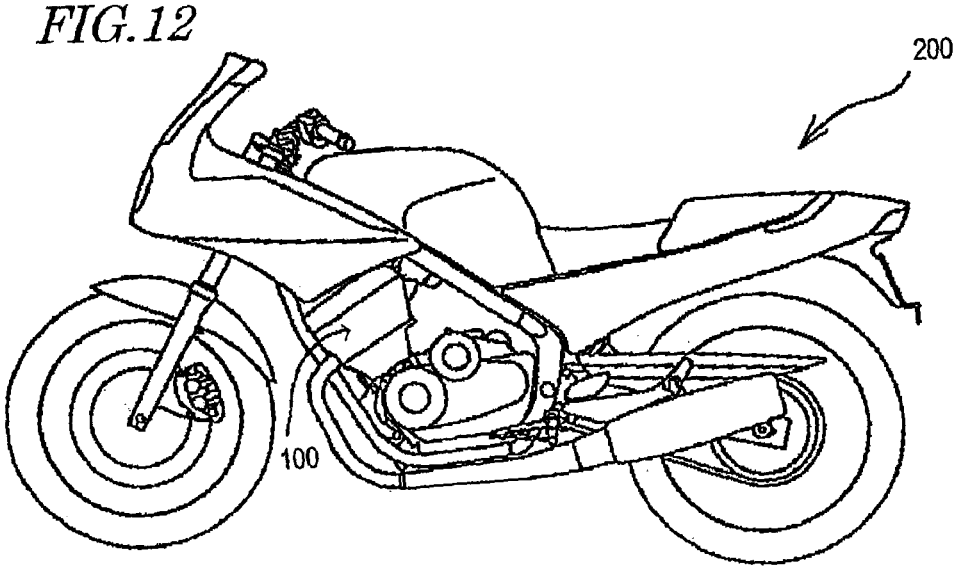
FIG. 12 is a side view schematically illustrating a motorcycle including the engine shown in FIG. 11.

FIG. 12 illustrates a motorcycle 200 including the engine 100 shown in FIG. 11. The motorcycle 200 includes the engine 100 that uses the titanium valve(s) 10 of this preferred embodiment, and therefore, has improved performance.

In the preferred embodiments described above, the present invention is preferably applied to an engine valve 10. However, the present invention is in no way limited to those specific preferred embodiments but may be applied to any titanium part to be exposed to a combustion gas in an internal combustion engine. For example, the present invention may be applied to a titanium connecting rod or to a butterfly valve for controlling the flow rate of an exhaust gas outside of a combustion chamber.

Also, in the preferred embodiments described above, the ceramic layer is preferably formed only on selected surface areas of a titanium part. However, the present invention is in no way limited to those specific preferred embodiments. As for a titanium part that does not have to have high abrasion resistance, the ceramic layer may cover the entire surface of the titanium part.

According to the present invention, a titanium part to be exposed to a combustion gas in an internal combustion engine can have increased fatigue strength and increased impact strength. The titanium part of the present invention can be used effectively as a part for any of various types of internal combustion engines. And an internal combustion engine including the titanium part of the present invention can be used effectively in any of numerous kinds of transportation apparatus.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Application No. 2005-181877 filed on Jun. 22, 2005, the entire contents of which are hereby incorporated by reference.

What is claimed is:

1. A part for use in an internal combustion engine comprising:

the part being made of titanium or a titanium alloy;

a titanium oxide layer provided directly on a surface of the titanium or titanium alloy; and a ceramic layer provided directly on a surface of the titanium oxide layer of the part, the ceramic layer having a thickness that is greater than about 10 nm but equal to or less than about 750 nm, the ceramic layer including either silicon or aluminum.

2. The part of claim 1, wherein the ceramic layer has a thickness of about 20 nm to about 500 nm.

3. The part of claim 1, wherein the ceramic layer has a thickness of about 50 nm to about 250 nm.

4. The part of claim 1, wherein the ceramic layer includes no greater than about 0.5 wt % of titanium.

5. The part of claim 1, wherein a number of particulate deposits having particle sizes of about 1 μm or more on a surface of the ceramic layer is at most about 80 per square millimeter.

6. The part of claim 1, wherein the ceramic layer includes a silicon oxide, a silicon nitride, or a silicon oxynitride.

7. The part of claim 1, wherein the ceramic layer includes an aluminum oxide, an aluminum nitride, or an aluminum oxynitride.

8. The part of claim 1, wherein the titanium oxide layer has a thickness of about 1 μm or less.

9. The part of claim 1, wherein the ceramic layer is provided on less than an entire surface area of the part.

10. The part of claim 9, wherein the titanium oxide layer has a thickness of at least about 10 μm on a surface area other than where the ceramic layer is provided.

11. The part of claim 1, wherein the part is a valve for use in a combustion chamber of an internal combustion engine.

12. The part of claim 11, wherein the valve is an exhaust valve that opens and closes an exhaust port of the internal combustion engine.

13. The part of claim 11, wherein the valve includes a stem portion, a face portion, and a neck portion that connects the stem and face portions together, wherein the ceramic layer covers a surface of the neck portion.

14. The part of claim 13, wherein the stem portion includes a cotter portion arranged to engage a valve cotter, wherein the ceramic layer also covers a surface of the cotter portion.

15. The part of claim 11, wherein the valve includes a stem portion with a cotter portion arranged to engage a valve cotter, wherein the ceramic layer covers a surface of the cotter portion.

16. The part of claim 1, wherein the ceramic layer is a vapor-deposited film.

17. The part of claim 16, wherein the ceramic layer is a sputtered vapor-deposited film.

18. An internal combustion engine comprising the part of claim 1.

19. A transportation apparatus comprising the internal combustion engine of claim 18.

20. A part for use in an internal combustion engine comprising:

the part being made of titanium or a titanium alloy;

a titanium oxide layer provided directly on a surface of the titanium or titanium alloy; and a ceramic layer provided directly on a surface of the titanium oxide layer of the part, the ceramic layer including either silicon or aluminum and no greater than about 0.5 wt % of titanium.

21. A part for use in an internal combustion engine comprising:

the part being made of titanium or a titanium alloy;

a titanium oxide layer provided directly on a surface of the titanium or titanium alloy; and a ceramic layer provided directly on a surface of the titanium oxide layer of the part, the ceramic layer having a thickness that is greater than about 10 nm but equal to or less than about 750 nm, the ceramic layer including no greater than about 0.5 wt % of titanium.

22. A part for use in an internal combustion engine comprising:

the part being made of either titanium or a titanium alloy;

a titanium oxide layer provided directly on a surface of the titanium or titanium alloy; and a ceramic layer provided directly on a surface of the titanium oxide layer of the part, the ceramic layer including either silicon or aluminum; wherein a number of particulate deposits having particle sizes of about 1 μm or more on a surface of the ceramic layer is at most about 80 per square millimeter.

23. A valve for use in an internal combustion engine comprising:

the valve being made of either titanium or a titanium alloy;

a titanium oxide layer provided directly on a surface of the titanium or titanium alloy; and a ceramic layer provided directly on a surface of the titanium or titanium alloy and on less than an entire surface area of the valve, the ceramic layer having a thickness that is greater than about 10 nm but equal to or less than about 750 nm, the ceramic layer including either silicon or aluminum.

* * * * *